US009091508B2

(12) United States Patent
Prieto

(10) Patent No.: US 9,091,508 B2
(45) Date of Patent: Jul. 28, 2015

(54) HINGED GUN MOUNT ASSEMBLY

(71) Applicant: Alliance Sports Group, L.P., Grand Prairie, TX (US)

(72) Inventor: Jaime Prieto, Forth Worth, TX (US)

(73) Assignee: Alliance Sports Group, L.P., Grand Prairie, TX (US)

( * ) Notice: Subject to any disclaimer, the term of this patent is extended or adjusted under 35 U.S.C. 154(b) by 42 days.

(21) Appl. No.: 14/154,005

(22) Filed: Jan. 13, 2014

(65) Prior Publication Data

US 2014/0305021 A1 Oct. 16, 2014

Related U.S. Application Data

(60) Provisional application No. 61/751,751, filed on Jan. 11, 2013.

(51) Int. Cl.
*F41C 27/00* (2006.01)
*F41G 11/00* (2006.01)

(52) U.S. Cl.
CPC ..... *F41G 11/003* (2013.01); *Y10T 29/49826* (2015.01)

(58) Field of Classification Search
USPC ..... 42/146, 90, 132; 362/109, 110, 112, 362/114
See application file for complete search history.

(56) References Cited

U.S. PATENT DOCUMENTS

| | | | | |
|---|---|---|---|---|
| 4,348,716 | A | 9/1982 | Storm et al. | |
| 4,524,534 | A | 6/1985 | Kaye et al. | |
| 4,697,226 | A | 9/1987 | Verdin | |
| 4,707,772 | A | 11/1987 | Jimenez et al. | |
| 5,253,443 | A * | 10/1993 | Baikrich | 42/115 |
| 7,188,978 | B2 | 3/2007 | Sharrah et al. | |
| 7,614,760 | B2 | 11/2009 | Sharrah et al. | |
| 7,676,981 | B2 | 3/2010 | Buckingham et al. | |
| 7,735,255 | B1 | 6/2010 | Kincaid et al. | |
| 7,954,971 | B1 | 6/2011 | Kincaid et al. | |
| D659,221 | S | 5/2012 | Wu et al. | |
| 8,296,991 | B1 | 10/2012 | Chung | |
| D672,839 | S | 12/2012 | Ding | |
| D675,281 | S | 1/2013 | Speroni | |
| 8,453,369 | B1 | 6/2013 | Kincaid et al. | |
| D700,674 | S | 3/2014 | Prieto | |
| 8,806,796 | B1 * | 8/2014 | Clifton | 42/90 |
| 2007/0068058 | A1 | 3/2007 | Remo | |
| 2009/0064558 | A1 | 3/2009 | Woroner | |
| 2010/0097789 | A1 | 4/2010 | Sharrah et al. | |
| 2010/0176741 | A1 | 7/2010 | Sharrah et al. | |
| 2012/0085014 | A1 | 4/2012 | Riley et al. | |
| 2012/0180368 | A1 | 7/2012 | Haley et al. | |
| 2012/0180370 | A1 | 7/2012 | McKinley | |
| 2013/0312307 | A1 * | 11/2013 | Rorick | 42/90 |
| 2014/0345181 | A1 * | 11/2014 | Teetzel et al. | 42/90 |

* cited by examiner

*Primary Examiner* — J. Woodrow Eldred
(74) *Attorney, Agent, or Firm* — Thorpe North & Western, LLP

(57) ABSTRACT

A hinged mounting assembly for use in connection with a gun-mounted light accessory is disclosed. The assembly has a light source disposed within a housing and a rail clamp connected to the housing. The rail clamp has a fixed clamp member attached to the housing and a hinged clamp member pivotally attached to the housing. The static clamp member and the hinged clamp member are disposed on opposite sides of the housing. A vertically moveable adjustment tab is attached to a first clamp post end. The adjustment tab has a cylindrical member with a lower half that is planar and an upper half that is arcuate. A vertically and horizontally adjustment tab is attached to a second clamp post end. The second adjustment tab also has a lower half that is planar and an upper half that is arcuate.

20 Claims, 5 Drawing Sheets

HINGED GUN MOUNT ASSEMBLY

FIELD OF THE INVENTION

The present invention relates to firearm mounted accessories and more particularly to an improved device for mounting a lighting device to a firearm.

BACKGROUND

A large variety of accessories have been developed for use in combination with firearms, tools, and other devices. In particular, accessories have been designed and developed to be mounted to a firearm, tool, or other device to enhance its use. Examples of such accessories include lights, sighting lasers, scopes, night vision devices, grips, flash and sound control devices, and bipods.

A common means of mounting such accessories is accomplished with an accessory mount, often in the form of a rail attached to the firearm, tool, or other device. A popular type of rail is the Picatinny rail, which is generally wedge shaped and provides a standardized accessory mounting platform. The Picatinny rail carries the official U.S. Government designation MIL-STD-1913. Not all mounts use a Picatinny rail system. Moreover, not all rail systems have standardized dimensions.

Rails are currently offered on nearly every type of firearm, from handguns to rifles and shotguns. Rails of various lengths are available to be coupled in various locations that are convenient with the varying accessories. For example, a rail may be located on the underside and near the front of a rifle barrel to accommodate advantageous placement of a bipod or a rail may be located on the top of a tactical rifle's upper receiver to accommodate attachment of a scope.

Rail systems allow a variety of accessories to be mounted on a firearm, tool, or device. Interchangeability of accessories allows a single firearm, tool, or device to be reconfigured to meet different needs. Rail systems are also useful if accessory mounting and removal can be accomplished quickly and easily. Therefore, it is advantageous that the system that mounts the accessory to the rail is easy and convenient to operate.

Firearms, whether used for hunting, sport, or military and law enforcement, are deadly instruments and as such, accuracy is paramount. Lights are common accessories because they provide illumination in low-light environments, which is critical for accuracy. Laser sights are also common accessories that assist accuracy by projecting a laser in the same direction as the firearm's bore and provide a reference for the shooter. Of course other mounted accessories are contemplated for use herein. Because many of the accessories used contribute to the accuracy of the firearm, it is important that the accessory remained fixed, despite being bumped and jostled during transport and use and despite the recoil force created by discharging the firearm.

Therefore, it is advantageous if the accessory is both easily attached and removed to allow for accessories to be easily exchanged based on current need, but also to be firmly attached to maximize accuracy.

SUMMARY OF THE INVENTION

The above-referenced need is satisfied with a firearm accessory mounting device in accordance with embodiments of the present invention. In accordance with one embodiment, a hinged mounting assembly for use in connection with a gun-mounted light accessory is disclosed. The assembly comprises a light source disposed within a housing and a rail clamp connected to the housing. The rail clamp comprises a static clamp member attached to the housing and a hinged clamp member pivotally attached to the housing. The static clamp member and the hinged clamp member are disposed on opposite sides of the housing. The assembly further comprises a vertically moveable adjustment tab attached to a first rod disposed in an aperture within the static clamp member and a vertically and horizontally second adjustment tab attached to a second rod disposed in an aperture within the hinged clamp member.

BRIEF DESCRIPTION OF THE DRAWINGS

Various embodiments of the present invention are shown and described in reference to the numbered drawings wherein.

It will be appreciated that the drawings are illustrative and not limiting of the scope of the invention that is defined by the claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
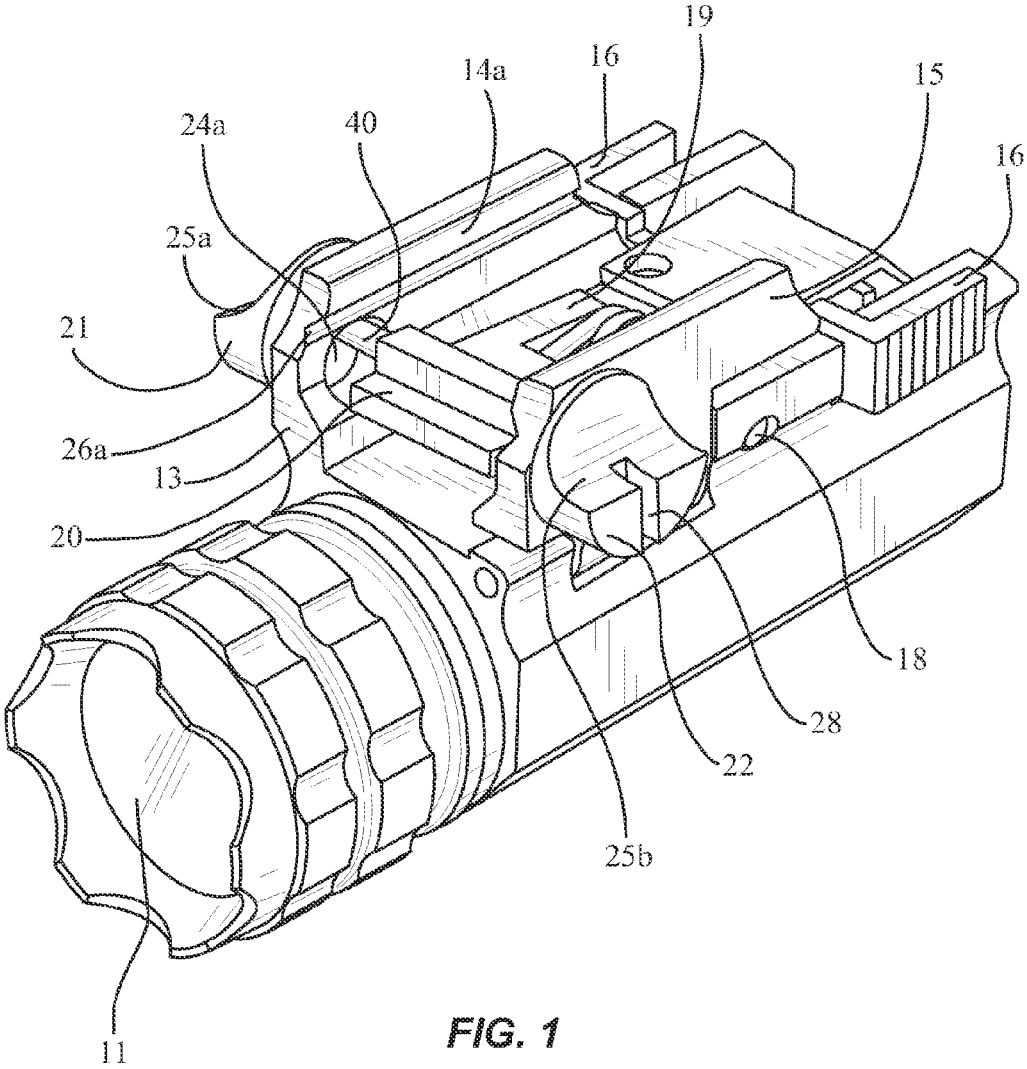
FIG. 1 shows a perspective view of a hinged mounting assembly in accordance with one embodiment of the invention.

Turning now to FIG. 1, a perspective view of a hinged mounting assembly in accordance with one embodiment of the invention is shown generally at 10. A light source 11 is disposed within a housing 12. A static rail clamp 13 is affixed to the housing 12. The static rail clamp 13 comprises a lip 14*a*, which forms the top portion of the static rail clamp 13. A hinged rail clamp 15 is pivotally attached to the housing 12 and positioned opposite the static rail clamp 13. In one aspect of the invention, the hinged rail clamp 15 comprises a lip 14*b*, which forms the top portion of the hinged rail clamp 15. A sliding switch 16 for turning power on and off to the light source is affixed to the housing 12 and may be depressed from either side of the housing 12. A key member 17 is positioned between the static rail clamp 13 and the hinged rail clamp 15.

The key member 17 comprises an anchor end 19 that is pivotally affixed to an anchor post 18 that is disposed within the housing 12. The key member 17 further comprises a front key end 20. A rod 40 of a non-rotatable adjustment tab 21 passes through aperture 24*a* in the static rail clamp 13 and attaches to the key member 17. Opposite the non-rotatable adjustment tab 21 is a rotatable adjustment tab 22 with a threaded rod 29 that passes through the aperture in the hinged rail clamp 15 and attaches to the key member 17. The aperture is smaller in diameter than the tabs 21 and 22 but larger in diameter than the rods 29 and 40 which allows both the non-rotatable adjustment tab 21 and the rotatable adjustment tab 22 to be moved up or down as the key member 17 pivots on the anchor post 18 but does not permit the tabs to pass through the aperture.

Accessory mounts are mounted to a rail system by sliding the accessory over the end of the mount and then securing the mount to the rail in some fashion. In accordance with one embodiment of the present invention, a biasing member (e.g., a spring) 23 is located between the housing 12 and the key member 17 so that the key member 17 is biased in an upward position and the non-rotatable adjustment tab 21 and the rotatable adjustment tab 22 are forced against the top of the aperture. In this manner, the key member 17 is biased in a "closed" position. By applying pressure to the tabs 21 and 22, the key member 17 may be moved downward into an "open" position to allow for the hinged mounting assembly 10 to be slid into place on the rail system and then secured by releasing the pressure on the tabs 21 and 22. While a spring is specifically referenced herein, it is understood that any biasing device may be used so long as the desired function of biasing the front end 20 of key member 17 in an upward position is achieved.

In accordance with one aspect of the invention, the rotatable adjustment tab 22 is threaded to the key member 17 so that as the rotatable adjustment tab 22 is rotated it becomes closer to the key member 17, thereby closing the hinged rail clamp 15 and decreasing the distance between the hinged rail clamp 15 and the static rail clamp 13. In this manner, the rotatable adjustment tab 22 is both vertically and horizontally adjustable while the non-rotatable adjustment tab 21 is only vertically adjustable.

The rotatable adjustment tab 22 comprises a slot 28. A flat-head screwdriver (or other implement) can be inserted into the slot 28 and used to rotate the rotatable adjustment tab 22. The rotatable adjustment tab 22 can also be rotated by finger. Advantageously, in one aspect of the invention, the rotatable adjustment tab 22 (located on the side proximal the hinged rail clamp) may be moved vertically independent of the movement of the other adjustment tab. In this manner, the hinged rail clamp 15 may be "opened" by depressing the rotatable adjustable tab member 22 and the mounting assembly may be removed without sliding the mounting assembly off of the rail. The hinged rail clamp 15 may also be used to accommodate different sized rail systems on which the assembly may be attached. In other words, due to variations in widths amongst different rail systems, the hinged rail clamp 15 may be used to adjust the width of the overall mounting assembly 10 in order to accommodate placement on different sized rail systems.

In accordance with one aspect of the invention, both the rotatable adjustment tab 22 and the non-rotatable adjustment tab 21 comprise a truncated side 25*a*, 25*b* that is ergonomically shaped to allow a user to comfortably apply simultaneous downward pressure to both the rotatable adjustment tab 22 and the non-rotatable adjustment tab 21, thereby applying pressure against the biasing member 23 and depressing the key member 17. The truncated side 25*a*, 25*b* of the tabs 21, 22 comprise a flat bottom face and an arcuate top face. The arcuate top face curves from a generally vertical orientation to a generally horizontal orientation when the tabs are positioned to be depressed by a user.

Figure 2:
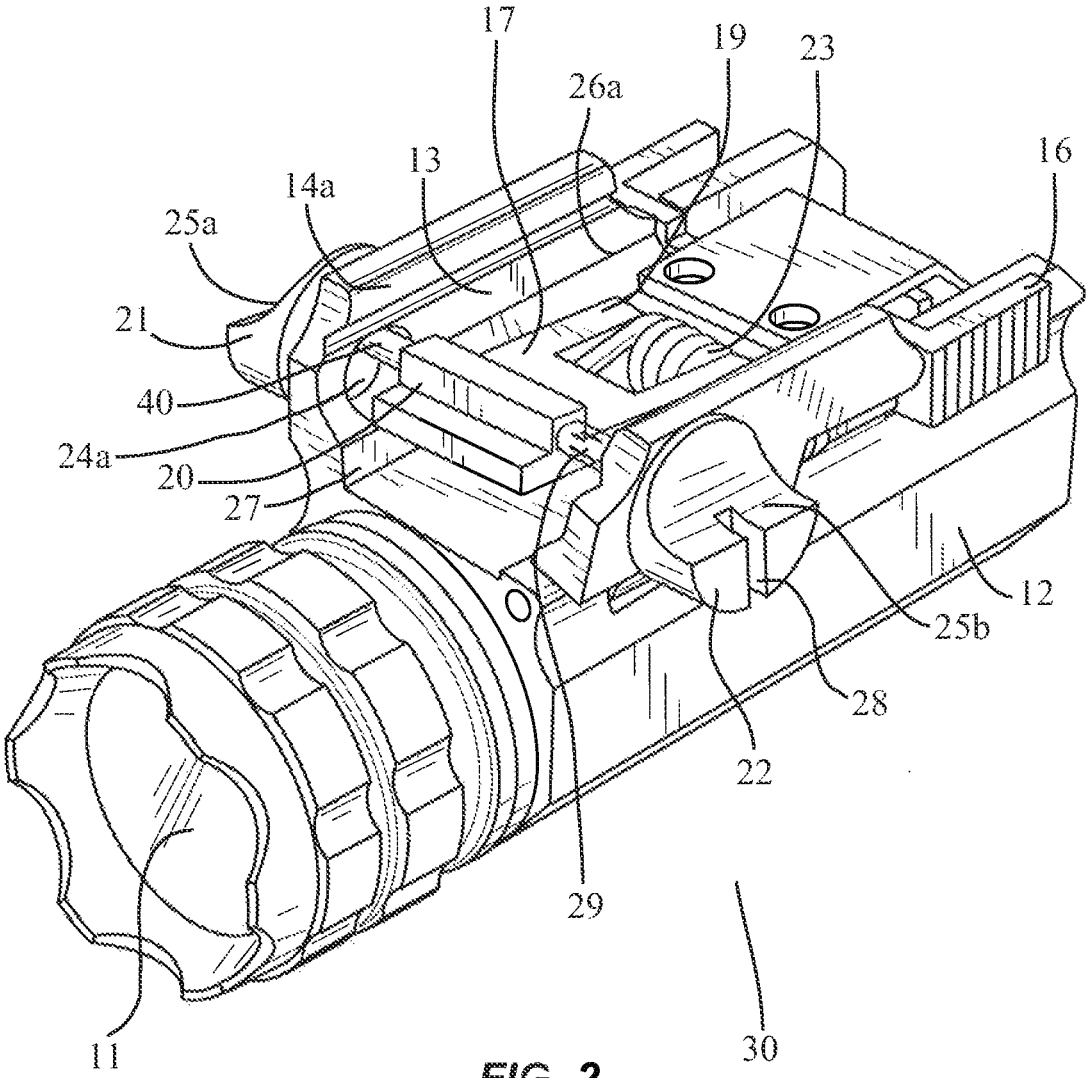
FIG. 2 shows a perspective view of the hinged mounting assembly of FIG. 1 in an open position.
Figure 3:
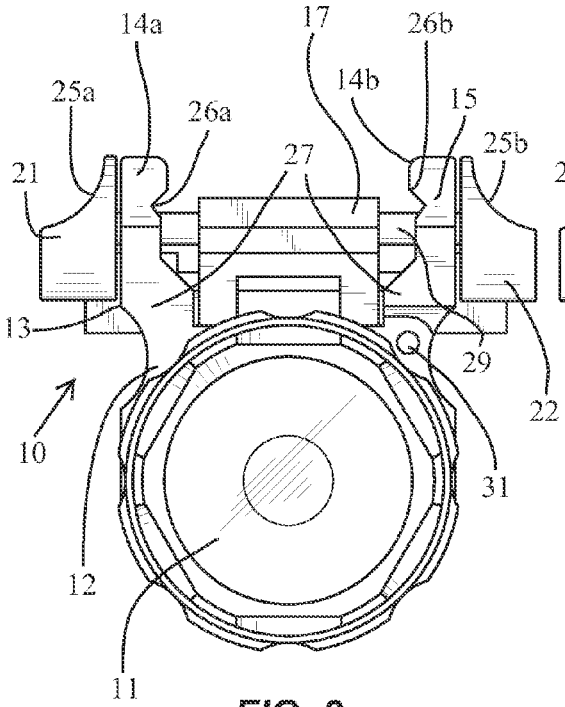
FIG. 3 shows a front view of the hinged mounting assembly of FIG. 1.
Figure 4:
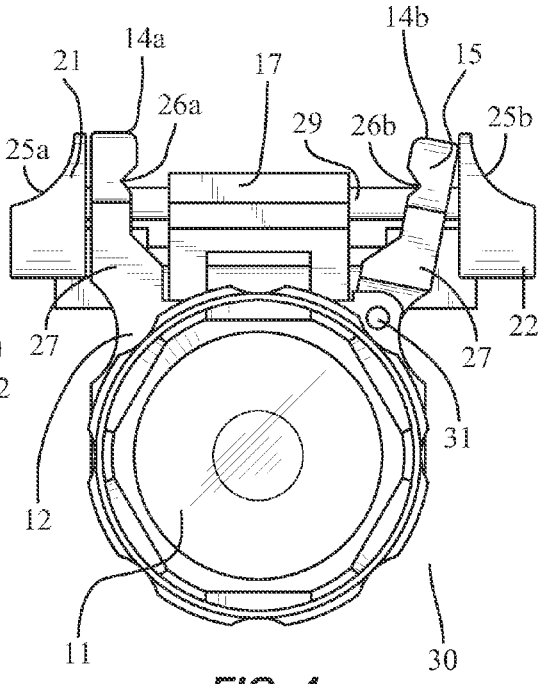
FIG. 4 shows a front view of the hinged mounting assembly of FIG. 2.

FIG. 2 shows a perspective view of a hinged mounting assembly in the open position generally at 30 in accordance with one embodiment of the present invention. With reference generally to FIGS. 1-9, a light source 11 is disposed within a housing 12. A static rail clamp 13 is affixed to the housing 12. The static rail clamp 13 comprises a lip 14*a*, 14*b*, which forms the top portion of the static rail clamp 13, a tapered groove 26*a*, 26*b* along the middle of the static rail clamp 13, and a base 27*a*, 27*b* along the bottom of the static rail clamp 13. The lip, tapered groove, and base cooperatively function to facilitate attachment of the accessory mount to a variety of rail systems. A hinged rail clamp 15 is pivotally attached to the housing 12 and positioned opposite the static rail clamp 13. The hinged rail clamp 15 comprises a lip 14*a*, 14*b*, which forms the top portion of the hinged rail clamp 15, a tapered groove 26*a*, 26*b* along the middle of the hinged rail clamp 14*a*, 14*b*, and a base 27*a*, 27*b* along the bottom of the hinged rail clamp 14*a*, 14*b*. The rotatable adjustment tab 22 is attached to the key member 17 by a threaded rod 29 so that as the rotatable adjustment tab 22 is rotated the threaded rod 29 pulls the rotatable adjustment tab 22 closer to the key member 17, thereby closing the hinged rail clamp 15 and decreasing the distance between the hinged rail clamp 15 and the static rail clamp 13. As the distance between the key member 17 and the rotatable adjustment tab 22 changes, the hinged rail clamp rotates about a hinge 31 that is attached to the housing 12. In other words, while both adjustment tabs are vertically adjustable, only the rotatable adjustment tab 22 is horizontally adjustable.

While a threaded rod assembly is specifically described herein, it is understood that other devices may be used for horizontal adjustment of the second tab member 22. For example, the threaded rod 29 may be fixedly attached to the rotatably adjustment tab 22 but configured for threaded engagement with the key member 17. Other examples include, but without limitation, compression fittings, luer connectors, and other adjustable connection devices known in the art may be used as suits a particular application.

As noted above, the rotatable adjustment tab 22 may be used to loosen the hinged rail clamp 15 to such a degree that the accessory mount 10 may be removed from a rail assembly without sliding the assembly off of the end of the rail system. Additionally, in the event the mount does not tightly fit against the rail system, the rotatable adjustment tab 22 may be employed to decrease the distance between rail clamps 13 and 15 to more firmly secure the accessory mount 10 onto the rail.

Figure 5:
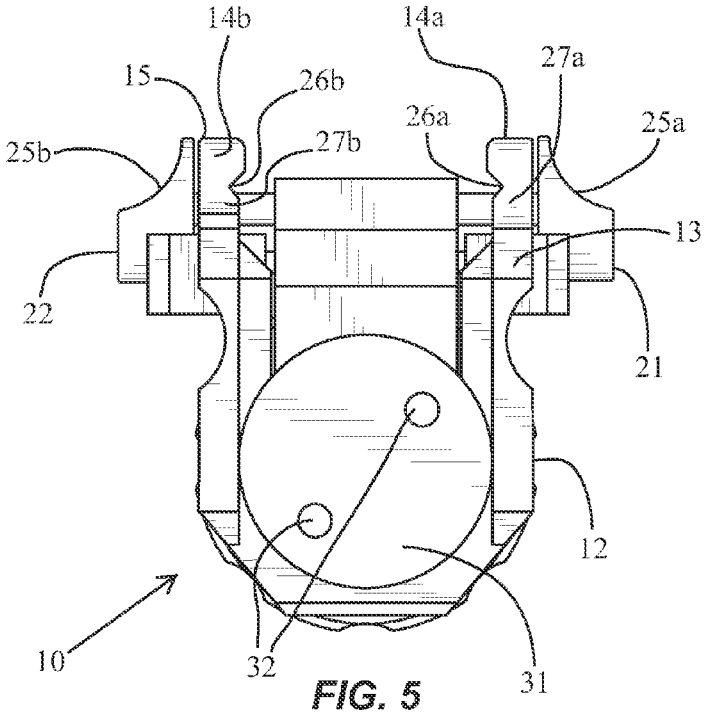
FIG. 5 shows a rear view of the hinged mounting assembly of FIG. 1.

FIG. 5 shows a rear view of a hinged mounting assembly shown generally at 10. A static rail clamp 13 is attached to a housing 12. A back plate 31 may be removed and replaced from the housing 12 using adjustment slots 32. The static rail clamp 13 comprises a lip 14*a*, 14*b* forming the top portion, a tapered groove 26*a*, 26*b*, and a base 27*a*, 27*b*. A hinged rail clamp 15 is attached to the housing 12 opposite the static rail clamp 13. The hinged rail clamp 15 comprises a lip 14*a*, 14*b* forming the top portion, a tapered groove 26*a*, 26*b*, and a base 27*a*, 27*b*.

Figure 6:
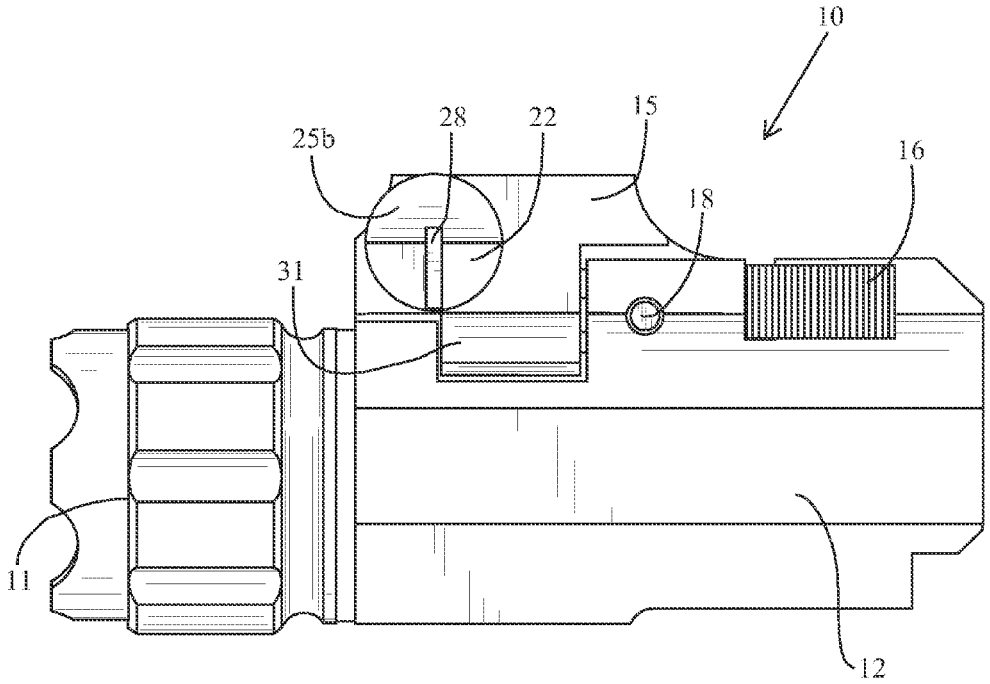
FIG. 6 shows a left-side view of the hinged mounting assembly of FIG. 1.

FIG. 6 shows a left-side view of a hinged mounting assembly shown generally at 10. A light source 11 is disposed within a housing 12. A hinged rail clamp 15 is rotatably attached to the housing 12 by a hinge 31. A rotatable adjustment tab 22 is attached to the hinged rail clamp 15. The rotatable adjustment tab 22 comprises a truncated side 25*a*,

25*b* and a slot 28. A sliding switch 16 is affixed to the housing 12. An anchor post 18 intersects the housing 12.

Figure 7:
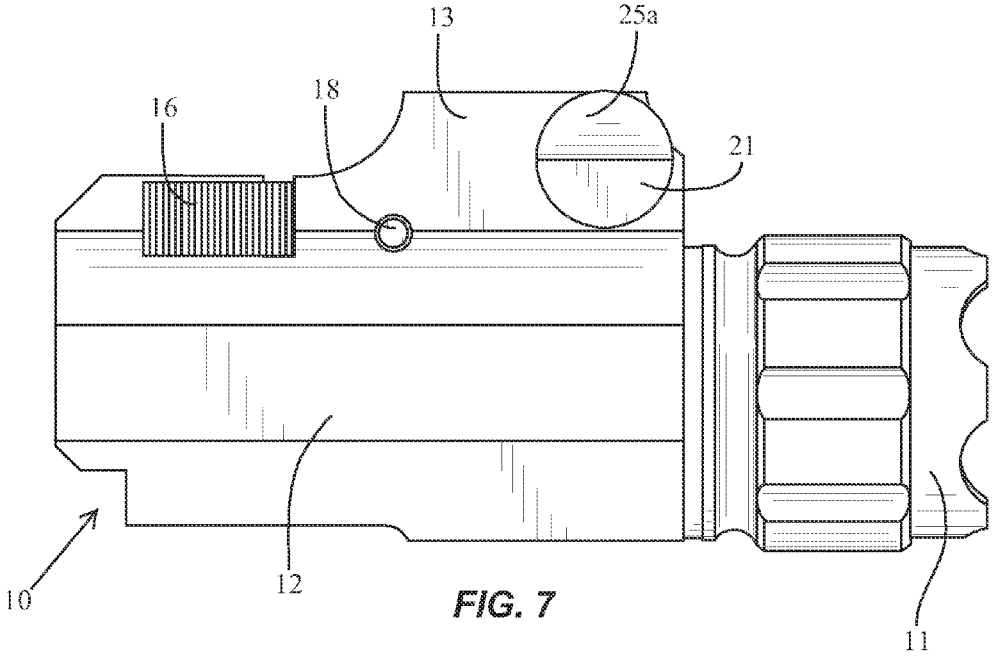
FIG. 7 shows a right-side view of the hinged mounting assembly of FIG. 1.
Figure 8:
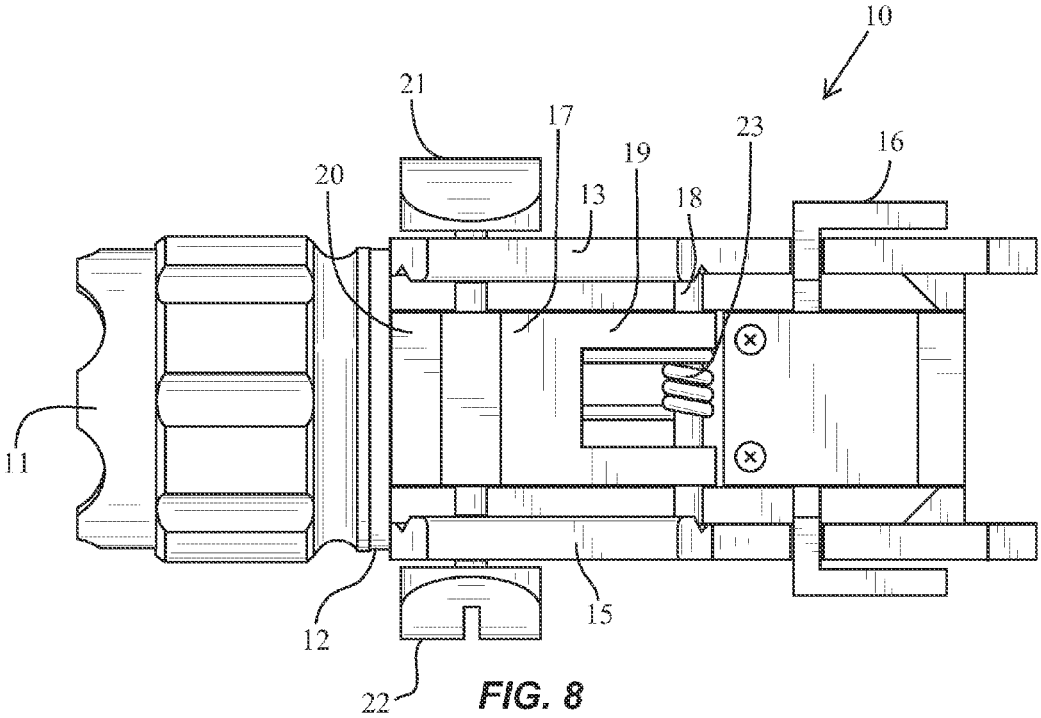
FIG. 8 shows a top view of the hinged mounting assembly of FIG. 1.
Figure 9:
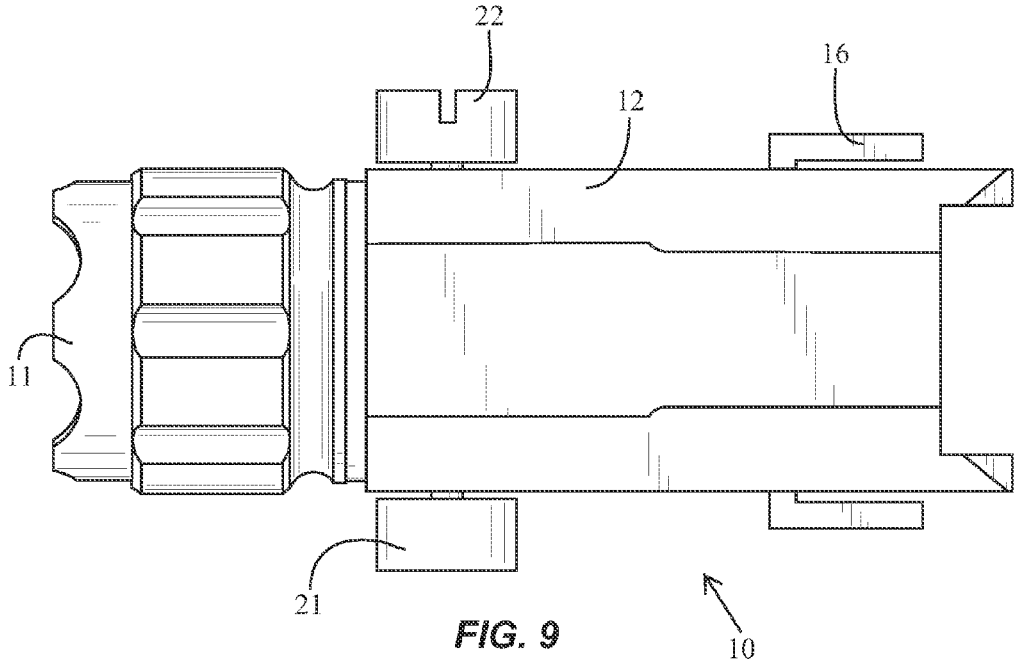
FIG. 9 shows a bottom view of the hinged mounting assembly of FIG. 1.

FIG. 7 shows a right-side view of a hinged mounting assembly shown generally at 10. A light source 11 is disposed within a housing 12. A static rail clamp 13 is attached to the housing 12. A non-rotatable adjustment tab 21 is attached to the static rail clamp 13. The non-rotatable adjustment tab 21 comprises a truncated side 25*a*, 25*b*. A sliding switch 16 is affixed to the housing 12. An anchor post 18 intersects the housing 12.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein. More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the invention should be determined solely by the appended claims and their legal equivalents, rather than by the descriptions and examples given above.

What is claimed is:

1. A hinged mounting assembly for use in connection with a gun-mounted light accessory comprising:

a. a light source disposed within a housing;

b. a rail clamp connected to the housing, wherein the rail clamp comprises a static clamp member attached to the housing and a hinged clamp member pivotally attached to the housing; wherein the static clamp member and the hinged clamp member are disposed on opposite sides of the housing;

c. a vertically moveable adjustment tab attached to a first rod disposed in an aperture within the static clamp member;

d. a vertically and horizontally moveable adjustment tab attached to a second rod disposed in an aperture within the hinged clamp member.

2. The hinged mounting assembly of claim 1, wherein the diameter of the first rod is less than the area of the aperture within the static clamp member and is slidably disposed within the aperture.

3. The hinged mounting assembly of claim 1, wherein the diameter of the second rod is less than the area of the aperture within the hinged clamp member and is slidably disposed within the aperture.

4. The hinged mounting assembly of claim 1, wherein a cylindrical member of the vertically moveable adjustment tab comprises a face, wherein a lower half of the face is planar and an upper half of the face is arcuate.

5. The hinged mounting assembly of claim 1, wherein a cylindrical member of the vertically and horizontally moveable adjustment tab comprises a face, wherein a lower half of the face is planar and an upper half of the face is arcuate.

6. The hinged mounting assembly of claim 1, further comprising a key member positioned between the static rail clamp and the hinged rail clamp.

7. The hinged mounting assembly of claim 6, wherein the key member comprises:

(a) an anchor end pivotally affixed to an anchor post; and (b) a front key end configured to be disposed within a rail system disposed on a firearm.

8. The hinged mounting assembly of claim 7, wherein the key member further comprises a spring member configured to bias the front key end in an upward position.

9. The hinged mounting assembly of claim 8, wherein the key member is operatively coupled to the vertically moveable adjustment tab and the vertically and horizontally adjustment tab.

10. A firearm assembly, comprising:

a firearm;

a hinged mounting assembly coupled to the firearm, the mounting assembly comprising:

a. a light source disposed within a housing;

b. a rail clamp connected to the housing, wherein the rail clamp comprises a static clamp member attached to the housing and a hinged clamp member pivotally attached to the housing; wherein the static clamp member and the hinged clamp member are disposed on opposite sides of the housing;

c. a vertically moveable adjustment tab attached to a first rod disposed in an aperture within the static clamp member;

d. a vertically and horizontally moveable adjustment tab attached to a second rod disposed in an aperture within the hinged clamp member.

11. The firearm assembly of claim 10, wherein the first and second rods are disposed on opposing sides of a key member configured for placement within a rail system disposed on the firearm.

12. The firearm assembly of claim 10, wherein the vertically moveable adjustment tab comprises a face, the face having a substantially planar bottom portion and an arcuate upper portion, wherein the arcuate top portion curves from a generally vertical orientation to a generally horizontal orientation.

13. The firearm assembly of claim 10, wherein the vertically and horizontally moveable adjustment tab comprises a face, the face having a substantially planar bottom portion and an arcuate upper portion, wherein the arcuate top portion curves from a generally vertical orientation to a generally horizontal orientation.

14. The firearm assembly of claim 10, wherein the second rod comprises a threaded male end coupled to a threaded female coupling within the vertically and horizontally moveable adjustment tab.

15. The firearm assembly of claim 10, wherein the vertical and horizontally moveable adjustment member comprises a rotatably cylindrical member.

16. A method of attaching an accessory to a firearm having a rail system attached thereto, comprising:

(a) accessing an accessory mounting device configured to be coupled to the rail system of the firearm; wherein the mounting device comprises:

a. a rail clamp connected to a housing, wherein the rail clamp comprises a static clamp member attached to the housing and an opposing hinged clamp member pivotally attached to the housing;

b. a vertically moveable adjustment tab attached to a first rod disposed in an aperture within the static clamp member;

c. a vertically and horizontally moveable adjustment tab attached to a second rod disposed in an aperture within the hinged clamp member (b) positioning the vertically and horizontally moveable adjustment tab in a downward position;

(c) positioning the accessory mounting device adjacent a side or bottom portion of the rail system;

(d) disposing the accessory mounting device on the rail system without positioning the mounting device about a front of the rail system.

17. The method of claim 16, wherein the accessory mounting device further comprises a key member positioned between the static rail clamp and the hinged rail clamp; wherein the key member comprises:

(a) an anchor end pivotally affixed to an anchor post;

(b) a front key end configured to be disposed within a rail system disposed on a firearm; and (c) a spring member configured to bias the front key end in an upward position.

18. The method of claim 17, further comprising depressing a portion of the front key end.

19. The method of claim 18, further comprising horizontally adjusting the vertically and horizontally moveable adjustment tab to increase the width between the static clamp member and the hinged clamp member.

20. The method of claim 19, further comprising horizontally adjusting the vertically and horizontally moveable adjustment tab to decrease the width between the static clamp member and the hinged clamp member.

* * * * *